US005284343A

United States Patent [19]

Bigornia et al.

[11] Patent Number: 5,284,343

[45] Date of Patent: Feb. 8, 1994

[54] PRACTICE HOCKEY PUCK

[76] Inventors: Boniface G. Bigornia; Susan Bigornia, both of 839 Tampico St., Walnut Creek, Calif. 94598

[21] Appl. No.: 870,567

[22] Filed: Apr. 17, 1992

[51] Int. Cl.[5] ..... A63B 21/00

[52] U.S. Cl. ..... 273/128 R

[58] Field of Search ..... 273/126 R, 126 A, 128 R, 273/128 A, 128 CS, 57.2; D21/199, 203, 204, 205

[56] References Cited

U.S. PATENT DOCUMENTS

| | | | |
|---|---|---|---|
| 2,327,371 | 8/1943 | Roy | 273/128 CS |
| 2,878,023 | 3/1959 | Decepoli | 273/128 R |
| 3,675,928 | 7/1972 | Gentile | 273/128 R |
| 3,704,891 | 12/1972 | Chiarelli | 273/128 R |
| 3,784,204 | 1/1974 | Felber | 273/128 R |
| 3,887,188 | 1/1975 | Beauchamp et al. | 273/128 R |
| 3,997,164 | 12/1976 | White, Sr. | 273/128 R |
| 4,078,801 | 3/1978 | White, Sr. | 273/128 R |
| 4,111,419 | 9/1978 | Pellegrino | 273/128 R |
| 4,153,253 | 5/1979 | White, Sr. | 273/128 R |
| 4,793,769 | 12/1988 | Dolan | 273/128 R |
| 4,801,144 | 1/1989 | De Masi, Jr. et al. | 273/128 R |
| 4,846,475 | 7/1989 | Newcomb et al. | 273/128 R |

FOREIGN PATENT DOCUMENTS

| | | | |
|---|---|---|---|
| 3512763 | 10/1986 | Fed. Rep. of Germany | 273/128 R |
| 3613523 | 10/1987 | Fed. Rep. of Germany | 273/128 CS |

*Primary Examiner*—V. Millin

*Assistant Examiner*—Raleigh W. Chiu

[57] ABSTRACT

The present invention is a practice hockey puck to improve the development of passing and shooting skills of "skaters" and puck-saving skills of "goalies." The puck is the same shape as a standard puck. It has a hollow body filled with removable material that allows the user to change the puck's weight. The material can be removed or inserted at the discretion of the user, so as to provide a wide range of training weights, from less than half up to more than twice that of a standard 170-gram (6-ounce) puck. A detachable cover is connected to the main body of the puck to keep the weighted material inside the cavity. Additionally, a number of linear markings on the surfaces and edge of the puck allow the user to monitor and analyze the spin of the puck, and thus determine how the shot could be improved.

4 Claims, 1 Drawing Sheet

PRACTICE HOCKEY PUCK

BACKGROUND OF THE INVENTION

1. Field of the Invention

This invention relates to a new type of hockey puck for practicing various skills required in the sport of ice hockey. The principal feature is the user's ability to easily vary the weight from less than half to over twice the weight of a standard 6-ounce hockey puck.

2. Description of Prior Art

Training in the sport of ice hockey involves individual and team practice to master numerous skills, including skating, passing, shooting, stick-handling, checking, and positional play. With the major objective of the game being to score more goals into the opponent's net, one of the more important aspects of the game is shooting and stick-handling (i.e., the controlling of the puck with the stick). And being a team sport, passing is equally important. Development of these skills requires repetition, either in the form of team drills during hockey practice, or individual training on one's own time (usually on a sheet of linoleum in a basement or garage, thus simulating a slick ice surface). Most often, a standard 6-ounce hockey puck is all that is available for these drills. This is a disadvantage for less-experienced players who have not yet developed the proper "feeling" of the coordinated snap of the wrists and the shifting of body weight required to master these skills. This large group includes younger, weaker players who can barely yet "raise" or flip the puck off the surface of the ice (or floor). These players need a lighter puck with which to practice.

Yet, the limitations of a standard 170-gram (6-ounce) puck also restrict the development and improvement of players who already have the strength and/or experience to "raise" a standard puck. Those more-experienced players would benefit from a more intense and strenuous practice session. These players need a heavier puck with which to practice.

The control of a hockey puck on a player's hockey stick involves a refined rolling of the wrists to allow the puck to move smoothly along the blade of the stick, from the heel to the toe. There are no devices that are in the prior art that allow a player or coach to analyze the movement and rotational velocity (i.e., spin) of the puck while on the player's stick and after he has shot the puck.

Prior art includes the following. U.S. Pat. No. 3,704,891, Chiarelli, issued 05 Dec. 1972, shows plans for a heavy puck that uses the vulcanization process to embed heavy weights within a puck body. The major feature of this invention and embodiments was the different ways of distributing the weights within the puck. The disadvantage is that the puck is always limited to a single weight. The player is thus constrained to what the manufacturer has determined to be the "right" weight to use. It would not be useful for the vast majority of the players who do not yet have a perfect "feel" for a heavier puck. Also, Chiarelli shows no visual guideline to analyze a puck's spin, as an aid in improving stick skills.

Other hockey pucks have been designed for road hockey use. Under U.S. Pat. No. 4,793,769, Dolan, issued 03 Mar. 1988, a puck with ball bearings allows simulation of a slippery ice surface but does not provide the user any ability to change the weight of the puck for training benefits. It also does not have a visual guideline to analyze a puck's spin, as an aid in improving stick skills.

U.S. Pat. No. 4,078,801, White Sr., issued 14 Mar. 1978, is an impact safety puck with foam between two flat plastic disks. In two embodiments of his invention, White provides a cavity allowing insertion of particulate matter. The disadvantage of those designs is again the limitation to a single weight. Once the cavity is filled, the design necessitates that it be permanently sealed, else the material may escape during play. A related disadvantage is that the material used to fill the cavity is limited to particulate matter. Other disadvantages are that a player cannot increase the weight beyond a normal puck for training purposes. Stronger players have no additional training benefit over a standard puck because the weight stays the same. It cannot be made easier or more difficult to control. Finally, the foam rubber exterior does not simulate the feeling of an official puck. It also does not have a visual guideline to analyze a puck's spin, as an aid in improving stick skills.

U.S. Pat. No. 4,111,419, Pellegrino, issued 05 Sep. 1978, shows a puck that is attached to an elastic cord which is attached to a hockey stick, the purpose being that the player can practice shooting skills without having to chase after the puck. This does not allow the user to change the weight of the training puck, nor does it provide a visual guideline to analyze the puck's spin, as an aid in improving stick skills like shooting.

U.S. Pat. No. 2,878,023, Decepoli, issued 17 Mar. 1959, describes a shuffleboard weight and U.S. Pat. No. 3,613,523, Rass, issued Oct. 1987, describes a curling stone. Both of these units are slid at slow controlled speeds in their respective games, and neither are suitable for the sport of ice hockey.

Also, three hockey pucks (U.S. Pat. No. 3,675,928, Gentile, issued 9 Sep. 1970, and U.S. Pat. No. 3,887,188, Beauchamp, issued Nov. 1972, and U.S. Pat. No. 3,512,763, Holm, issued Oct. 1986) have been designed with safety as the purpose, each having a soft impact surface. Beauchamp's puck is made of felt, Gentile's puck has an air-filled, tube-like, rubber circumference, and Holm has a soft outer covering. Practicing ice hockey with safety pucks does not allow a player to reap the maximum benefits from the increased (weight) resistance of my heavy puck. Again, the disadvantage is that these pucks only provide a single weight with which to practice. Also, the highly resilient exterior necessitated by the safety feature does not simulate the feeling of an official puck. Also, none of the pucks have a visual guideline to analyze their puck's spin, as an aid in improving stick skills.

Gentile's puck recites colorful markings for greater visibility and appeal; however, this does not satisfy my hockey puck's purpose of analyzing rotational velocity. No other prior art addresses or solves this particular problem.

BRIEF SUMMARY OF THE INVENTION

My practice hockey puck is different from all of the prior art. Different people develop their skills at different rates. My variable-weight puck allows players of all abilities to develop at their maximum rate by letting them change the weight of their practice puck as they progress. In the prior art, there is no known apparatus for this purpose. The more-advanced players can use my puck at its maximum weight, twice that of a standard puck. This produces increased resistance training for the muscle movements required for shooting and passing. As proven in other sports (e.g., swinging a baseball bat with a weighted ring, e.g., a donut), this increased resistance training will improve the stick speed, the shot, the pass, and the player's confidence. The hockey stick will feel lighter when using it with a standard puck in a game situation. The player will develop a stronger, more accurate shot, and his/her other "stick-skills" (i.e., passing and stickhandling) will improve at a much quicker rate. Stickhandling is the skill of controlling a puck with one's hockey stick by moving it from one side of the stick to the other. It generally involves a moving player.

A puck that is heavier-than-normal is not appropriate for novice players. Weaker or less experienced players can use my puck in the lighter phase until they have mastered the proper coordinated snap of the wrists and the shifting of body weight, i.e., the "feel" of a good shot or pass. A puck that is twice the weight of a standard puck is too heavy for many intermediate-level players. Also, lighter-than-normal road hockey pucks are too light for novice players who are ready to advance to something heavier, yet not quite ready for a standard puck. It is obvious that, with such a wide range of abilities, it would be best to have an innumerable number of puck weights from which to chose. My hockey puck can provide an innumerable choice of weights, thus having a clear advantage over single-weight puck. In baseball, not everyone practices their batting swings with the same weight of batting donut. In ice hockey, the same training principal should apply.

This variable-weight puck is also advantageous for teaching young goalies. When a hard standard 170-gram (6-ounce) puck is shot at a novice hockey goalie, he/she experiences a great deal of pain, despite the heavy padding. This causes him/her to flinch and shy away from shots at the goal, a term called being "puck-shy." Goalies are understandably "puck-shy" when they are first learning how to block pucks. A lighter, intermediate-weight puck would provide a good transition for beginning goalies, as they still can develop their reflexes without developing an instinctive fear of injury.

My puck also has unique visual markings that can help a player or his/her coach analyze shots and the resulting spin (rotational velocity) of the puck. The spin is different for each type of shot, e.g., wristshot, slap-shot, backhand, and snap-shot. The optical guidelines can be used to compare good shots versus bad ones. It can show whether more "wrist-action" is needed or if the timing of the weight-transfer should be adjusted. This field of training is yet unknown, but this puck would allow the technology to advance forward to approach that of other sports.

LIST OF PART REFERENCE NUMBERS

| No. | Part |
|---|---|
| 10 | Main Body |
| 12 | Denser-Than-Rubber Particulate Material |
| 14 | Cover |
| 16 | Recessed Hole in Main Body |
| 18 | Recessed Hole in Cover |
| 20 | Bolt |
| 22 | Nut |
| 24 | Groove in Cover |
| 26 | Lip on Opening in Main Body |
| 28 | Center Post in Main Body |
| 32 | Metallic Disks |
| 36 | Line Markings |
| 38 | Rigid Skeleton (Steel or Aluminum) for Main Body |
| 40 | Rubber Coating for Rigid Skeleton |

DETAILED DESCRIPTION OF THE INVENTION

MAIN EMBODIMENT

Description

Figure 1:
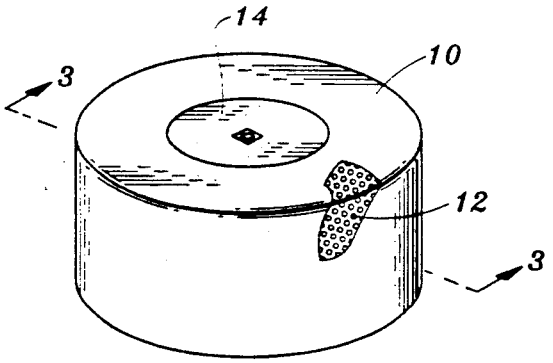
FIG. 1 is a perspective view of one embodiment of the invention; having a portion of the puck cut away.

Referring to FIG. 1, my hockey puck has the same external size as a standard (official) hockey puck, i.e., 76 mm (3 inches) in diameter and 25 mm (1 inch) thick. The puck has a hollow main body 10, filled with removable denser-than-rubber particulate material 12 to act as weights.

Figure 2:
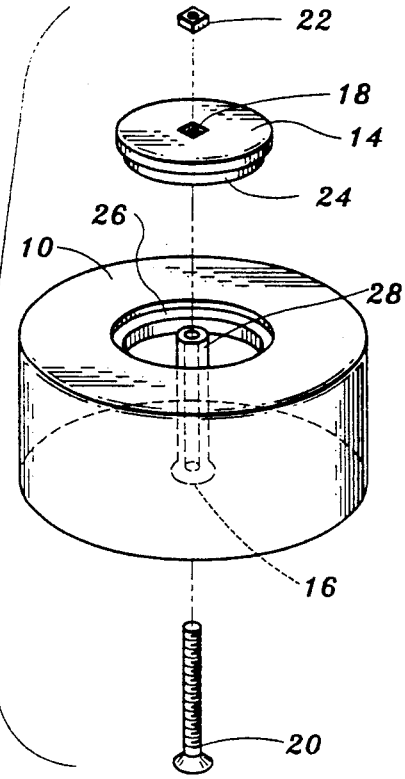
FIG. 2 is an exploded perspective view of the main body, the cover and the connecting nut and bolt.

Referring to FIG. 2, main body 10 is a made of a synthetic or naturally occurring rubber, elastomer or plastic polymer such as polyurethane, nitrile rubber, polypropylene or styrene-butadiene. A circular cover 14 of material similar to main body 10 covers an opening on the top face of main body 10, through which denser-than-rubber particulate material 12 can be removed. Both main body 10 and cover 14 are made from a transfer molding or similar manufacturing process. Resins such as glass may be added prior to curing to add to the strength of the material. The wall thickness ranges from 3.2 mm to 6.4 mm ($\frac{1}{8}$ inch to $\frac{1}{4}$ inch). Both main body 10 and cover 14 have recessed holes 16 and 18 respectively, in the center of their flat surfaces to accommodate a flat head bolt 20 and nut 22 respectively. Bolt 20 and nut 22 attach cover 14 to main body 10.

Figure 3:
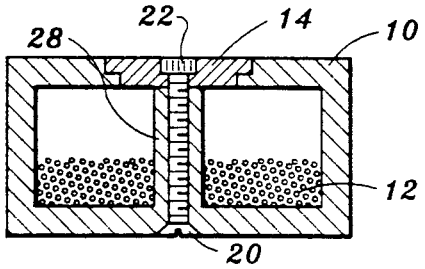
FIG. 3 is a side sectional view of one embodiment of the assembled hockey puck.

Referring to FIG. 3, holes 16 and 18 produce a reasonably flush top and bottom surface for the puck, because nut 22 and the head of bolt 20 are recessed below the flat surface. Furthermore, a groove 24 is cut into the perimeter of cover 14 to fit into a similarly-sized lip 26 cut into perimeter of the opening of main body 10. This allows cover 14 to sit on main body 10, which uses lip 26 to support cover 14. In addition, to provide extra support for cover 14, a center post 28 is part of main body 10. Groove 24, lip 26 and post 28 are not essential parts of the invention because many attachment methods are suitable. Thus, this specification is not detailed in the claims. Similarly, denser-than-rubber particulate material 12 could be replaced with any other solid particulate matter to produce the same effect for the variable-weight puck.

Operation

Assembly of the puck involves filling the main body with denser-than-rubber weights 12 and screwing on cover 14 using nut 22 and bolt 20. Nut 22 and bolt 20 pass through holes 16 and 18 in cover 14 and main body 10. The resulting puck has the same external shape as a standard puck but now weighs about 340 grams (12 ounces), twice the weight of a standard puck. If the player wants to reduce the puck weight, because the level of difficulty is too high, the player unscrews cover 14, removes some of the denser-than-rubber particulate material 12 to get the desired weight, and then screws cover 14 back on. The resulting puck is as light or as heavy as needed. Before screwing cover 14 back on, the player can put other material into the puck to fill the space left by removed denser-than-rubber particulate material 12 but this is not essential. The player may also remove all the denser-than-rubber particulate material 12, resulting in a very light, 85-gram (3-ounce) practice puck that is one half the weight of a standard puck. By using this procedure, my puck has a wide range of weights, depending on how many of the denser-than-rubber particulate material 12 are left in the cavity of main body 10.

Advantages

My puck combines the advantages of both a heavy puck and a light puck into one. Thus, a great deal of flexibility is afforded the user.

My puck allows stronger players to practice with a heavier puck, resulting in harder shots, crisper passes and better control in actual game situations, when an official puck is used.

As a team, practicing with a heavier puck immediately before a game will create an advantage for that team during the game. They would be used to the heavier feel, such that when a standard (lighter) puck is used in the game, it feels lighter and much easier to control, much like the batting donut in baseball makes the bat feel lighter when the batter steps up to the plate.

My puck allows less-experienced and younger players to work on their skills with a lighter puck, adding weight as they advance their way up to the standard 170-gram (6-ounce) puck and beyond. Inexperienced and younger players do not have the ability to "raise" shots and "flip" passes off the ice surface with a standard puck. A lighter puck allows the player to develop a feel and confidence for handling a puck, vastly improving the rate of improvement and the learning process. More denser-than-rubber particulate material 12 may be added as the player's ability improves. The large opening allows the use of larger weights, if desired by the user, i.e., the utility of the puck is not limited to particulate matter, which could leak out during use.

My puck can also be used in the lighter phase during scrimmages or playing hockey without complete padding, both on the ice, or when playing road hockey.

In the lighter, "empty" phase, my puck allows younger goalies to practice without fear of injury.

OTHER EMBODIMENTS

Figure 4A:
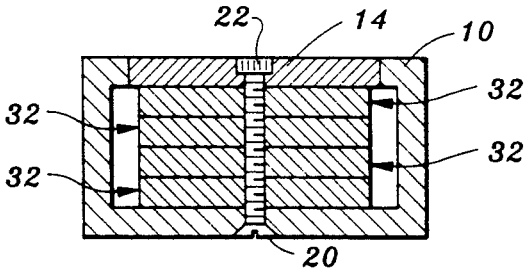
FIG. 4A is a side sectional view of one embodiment of the assembled hockey puck; having metallic disks inserted in the cavity.
Figure 4B:
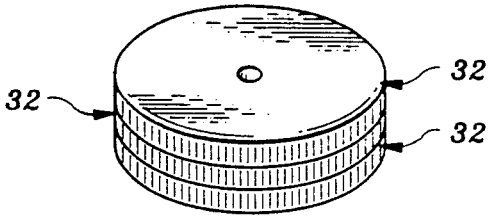
FIG. 4B is a perspective view of metallic disks.

Referring to FIG. 4A and 4B, a further embodiment of the invention is the use of a different material in the cavity to provide the weight. Up to 6 thin, circular metallic disks 32 are stacked in the puck cavity to provide the extra weight. Cover 14 is screwed on after metallic disks 32 are emplaced. To create a lighter puck, cover 14 is unscrewed, a number of the metallic disks 32 are removed. Cover 14 is screwed back on. The result is the same, a puck with a wide range of weights.

The advantage of this embodiment is that it is easier for the user to adjust the weight of the puck. The fewer number of weights provides a simple incremental increase or decrease by the user in setting the weight of the training puck. The disadvantage is that it may be too expensive to produce in order for it to still be acceptable in price to the consumer.

Figure 5:
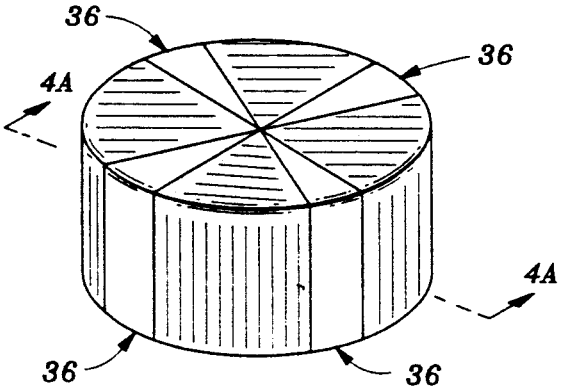
FIG. 5 is a perspective view of one embodiment of the invention; having line markings that act as a visual guide.

Referring to FIG. 5, a further embodiment of this invention is line markings 36 on both flat sides and the curved edge of the puck. Line markings 36 are affixed by decals with a highly adhesive side. However, several other imprinting methods are acceptable, including silk-screening after the molding process. FIG. 5 shows one design option, where 4 white lines on the black puck pass through the center of the puck. The 4 line markings 36 are 6.4 mm (¼ inch) thick at the outer edge of the puck and converge to a point in the center of the puck on both faces. However, many different design line markings 36 are acceptable and this embodiment is not limited to the specific design shown in FIG. 5.

The advantage is that line markings 36 provide the player and/or coach with a visual guideline to monitor the spin (rotational velocity) of the puck. It gives the player or coach a better understanding of how the puck is being shot or passed, i.e., by observing and comparing the changes in spin from one shot/pass to the next. In most other major sports, the movement of a projectile such as a baseball, football, etc., can be used to determine how the player's motion could be changed to either improve or return to the "rhythm" that was successful. In ice hockey, this would pertain to the passing or shooting with the hockey stick. It also teaches players and goalies to concentrate more on the puck, due to focussing not just on the puck, but on its rotational movement (spin) indicated by the line markings 36.

Figure 6:
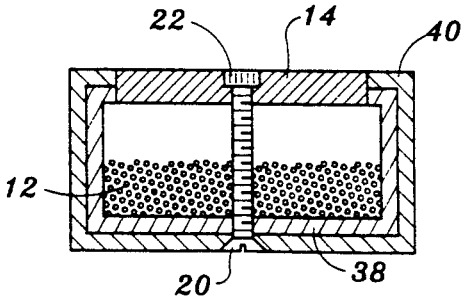
FIG. 6 is a side sectional view of one embodiment of the invention; the main body made of aluminum or steel covered by a rubber coating on the exterior.

Referring to FIG. 6, a further embodiment of my puck is to provide a supporting skeleton 38 made of a rigid material such as aluminum or steel, giving added structural strength to the puck. Rigid skeleton 38 is thin-walled (less than 3.2 mm (⅛ inch)) with a diameter and height being 6.4 mm (¼ inch) smaller than a standard puck. To create the same final dimensions as a standard puck, a coating 40 of material such as a polymer or synthetic rubber is added by one of several available mold processes. Weights are added or removed as is done with the main embodiment. The result, as in the main embodiment, is a puck with a wide range of weights.

The advantage of this embodiment is that the rigid skeleton 38 results in an even stronger, more durable puck. The disadvantage is that this added strength is likely not required, and the resulting increase in the cost of producing the puck may be too expensive to be acceptable in price to the consumer. Thus, this embodiment would be selected only if field testing were to indicate that a plastic polymer reinforced (with resin) additives) were not suitable.

CONCLUSIONS, RAMIFICATIONS, AND SCOPE OF THE INVENTION

The reader will see that the practice hockey puck provides a revolutionary training tool for practicing stick skills in the sport of ice hockey.

While my above description contains many specifications, these should not be construed as limitations on the scope of the invention, but rather as exemplification of one preferred embodiment thereof. Many other variations are possible. For example, the cover for the main body could be attached and secured by many different means, but this simple and effective means ( i.e., a nut and bolt) was used for description in the specifications. The design markings could be a color other than white and would still produce the desired effect. Accordingly, the scope of the invention should be determined not by the embodiments illustrated, but by the appended claims and their legal equivalents.

The embodiments of the invention in which an exclusive property or privilege is claimed are defined as follows:

1. A practice hockey puck comprising:
a) a main body member having generally flat top and bottom surfaces joined by a cylindrical side surface generally in the form of a hockey puck, said main body member having a cavity for receiving a plurality of weighted means,
b) a plurality of weighted means emplaced within said cavity,
c) a flat cover member having sufficient size to cover said cavity,
d) a means for joining said main body member to said cover member, so as to retain said plurality of weighted means within said cavity, and
e) a plurality of line markings on said flat top and bottom surfaces and said cylindrical side surface, having one color, wherein said plurality of line markings pass through the center of said flat top and bottom surfaces, whereby said plurality of line markings provide a visual guideline to analyze the rotational velocity of said practice hockey puck.

2. A practice hockey puck comprising:
a) a main body member having generally flat top and bottom surfaces joined by a cylindrical side surface in the form of a hockey puck,
b) a plurality of line markings on said flat top and bottom surfaces and said cylindrical side surface, having one color, wherein said plurality of line markings pass through the center of said flat top and bottom surfaces, whereby said plurality of line markings provide a visual guideline to analyze the rotational velocity of said practice hockey puck.

3. A practice hockey puck comprising:
a) a main body member made of rigid material having generally flat top and bottom surfaces joined by a cylindrical side surface having smaller diameter and height than a standard hockey puck, said main body member having a cavity for receiving a plurality of removable weighted means,
b) an exterior coating to said main body, made of rubber material, whereby said practice hockey puck has substantially same diameter and height as said standard hockey puck,
c) said plurality of removable weighted means emplaced within said cavity, whereby the weight of said practice hockey puck is adjustable, such that the practice puck can become heavier than, and can also become lighter than said standard hockey puck,
d) a flat cover member having sufficient size to cover said cavity, and
e) a means for joining said main body member to said cover member, so as to retain said plurality of weighted means within said cavity, whereby said means for joining said body member to said cover member is detachable, whereby said plurality of weighted means is removable.

4. The practice hockey puck of claim 3, further including a plurality of line markings on said flat top and bottom surfaces and said cylindrical side surface, having one color, wherein said plurality of line markings pass through the center of said flat top and bottom surfaces, whereby said plurality of line markings provide a visual guideline to analyze the rotational velocity of said practice hockey puck.

* * * * *